US006237462B1

(12) United States Patent
Hawkes et al.

(10) Patent No.: US 6,237,462 B1
(45) Date of Patent: May 29, 2001

(54) PORTABLE TELEPRESENT AIMING SYSTEM

(75) Inventors: Graham S. Hawkes, San Anselmo; Howard F. Konvalin, Point Richmond, both of CA (US)

(73) Assignee: Tactical Telepresent Technolgies, Inc., San Anselmo, CA (US)

( * ) Notice: Subject to any disclaimer, the term of this patent is extended or adjusted under 35 U.S.C. 154(b) by 0 days.

(21) Appl. No.: 09/084,788

(22) Filed: May 21, 1998

(51) Int. Cl.[7] ..... F41G 5/06
(52) U.S. Cl. ..... 89/41.05; 89/37.05; 89/41.17
(58) Field of Search ..... 89/37.01, 41.17, 89/41.05; 42/94

(56) References Cited

U.S. PATENT DOCUMENTS

| | | | | |
|---|---|---|---|---|
| 3,010,369 | * | 11/1961 | Musser et al. | 89/41.17 |
| 3,389,637 | * | 6/1968 | Beier et al. | 89/37.01 |
| 3,494,250 | * | 2/1970 | Pfister | 89/37.01 |
| 3,504,122 | * | 3/1970 | Ratliff, Jr. | 89/41.05 |
| 3,641,261 | * | 2/1972 | Chaplin et al. | 178/7.8 |
| 3,711,638 | * | 1/1973 | Davies | 178/6.8 |
| 3,862,584 | * | 1/1975 | Schmidt et al. | 89/1.8 |
| 4,267,562 | * | 5/1981 | Raimondi | 358/109 |
| 4,326,340 | * | 4/1982 | Blomqvist et al. | 33/238 |
| 4,386,848 | * | 6/1983 | Clendenin et al. | 356/5 |
| 4,558,627 | * | 12/1985 | LeBlanc et al. | 89/41.03 |
| 4,570,530 | * | 2/1986 | Armstrong | 89/41.05 |
| 4,579,035 | * | 4/1986 | Whiting | 89/41.05 |
| 4,580,483 | * | 4/1986 | Garbini | 89/40.06 |
| 4,686,888 | * | 8/1987 | Sanborn et al. | 89/37.13 |
| 4,787,291 | * | 11/1988 | Frohock, Jr. | 89/41.22 |
| 4,885,977 | * | 12/1989 | Kirson et al. | 89/41.05 |
| 4,922,801 | * | 5/1990 | Jaquard et al. | 89/41.05 |
| 5,067,268 | * | 11/1991 | Ransom | 42/94 |
| 5,200,827 | * | 4/1993 | Hanson et al. | 358/2.11 |
| 5,263,396 | * | 11/1993 | Ladan et al. | 89/1.11 |
| 5,568,152 | * | 10/1996 | Janky et al. | 342/357 |
| 5,586,887 | * | 12/1996 | McNelis et al. | 434/20 |
| 5,599,187 | | 2/1997 | Mesiano . | |
| 5,648,632 | * | 7/1997 | Becker et al. | 89/41.05 |
| 5,686,690 | * | 11/1997 | Lougheed et al. | 89/41.17 |
| 5,824,942 | * | 10/1998 | Mladjan et al. | 889/41.17 |
| 5,949,015 | * | 9/1999 | Smith et al. | 89/41.05 |

* cited by examiner

*Primary Examiner*—Michael J. Carone
*Assistant Examiner*—Denise J Buckley
(74) *Attorney, Agent, or Firm*—Thelen Reid & Priest LLP; Gil G. Silberman

(57) ABSTRACT

The present invention provides a powered aiming platform for pointing devices such as firearms, illumination devices, or sensing instruments, remotely controlled by a hand-controller device, with video feedback of the aiming position and audio feedback of the exact direction and speed of positioning movements. The present invention overcomes the safety and accuracy limitations of manual and conventional remotely-controlled aiming mechanisms, thereby allowing operators to point devices accurately and quickly with predictable, precise control. In the case of firearms, the present invention maintains a steady position after repeated firing.

1 Claim, 11 Drawing Sheets

PORTABLE TELEPRESENT AIMING SYSTEM

BACKGROUND OF THE INVENTION

1. Field of the Invention

The present invention relates generally to aiming systems, and specifically to portable remotely-controlled aiming mechanisms for pointing firearms and other devices at an intended target, as well as video feedback components of such systems indicating the direction of aim, and audio feedback indicating changes in the direction of aim.

2. Description of Related Art

The typical means for aiming small portable devices such as firearms, optical instruments, cameras, and spotlights, is for a human operator to aim the device by hand in the direction of the intended target, while physically supporting the device. Control feedback is provided by estimating the optimal direction of aim in advance, aiming the device as close as practical to the intended direction, and then making minor corrections to the direction in response to observed errors in targeting. Effective operation of such devices generally requires the user to aim the device accurately in a variety of conditions. However, accuracy is often degraded when the user is unable to steady the device, when the operator experiences fatigue due in part to the physical stress of operating the device, by lack of fine control in the direction of aim (particularly when making quick gross changes of aiming position), and by a variety of responses the operator may make in response to hostile environments.

Portable firearms, such as semiautomatic rifles, present special safety and operational difficulties for their operators. Because they emit single projectiles or discrete bursts of projectiles in a particular direction, rather than performing continuously, firearms do not provide continuous or real-time feedback on the current point of aim. Furthermore, because firearms impart significant inertia into their projectiles, the corresponding recoil may overcome the operator's capacity to steady the firearm steady while firing. The recoil thus causes a slight or gross change in the direction of aim following firing, requiring re-aiming of the firearm after each projectile or round of projectiles, creating a corresponding limits the fine control of aim that would otherwise be obtainable by iterative re-aiming. Furthermore, combat situations typically encountered by police or light infantry soldiers involve substantial physical danger for the operator, who must take defensive steps to avoid injury. Such steps greatly increase the training time required to learn how to use a firearm in hostile environments, and severely reduce the aiming accuracy and firing frequency.

Several existing technological enhancements help operators overcome accuracy and safety difficulties when aiming small portable devices. Accuracy is improved by the use of sights and spotting telescopes, by reticles, and by other pointing aids. Stability and support may be provided by steadying devices against a fixed object or by mounting devices on a tripod or other support structure. Safety may be improved by providing armor or other physical protection for the operator or, in the cases of firearms operated under hostile fire, by hiding behind protective battlements or by taking evasive maneuvers.

One way to significantly improve both stability and safety of aiming devices is to aim and operate such devices remotely rather than by direct manipulation. Remote operation systems typically involve mounting devices such as firearms on a carriage, with means to position the carriage in response to electronic control signals. An operator controls the device remotely by means of a portable hand controller. By mounting a device on a carriage rather than in the operator's hand, and by supporting the device on a base rather than on the frame of the operator's body, the operator ensures that the aiming position remains stationary rather than deviating over time. Video feedback may be incorporated into the aiming system so that an operator can view the target remotely on a monitor, often magnified via a telephoto lens. This enables the operator to remain at a distance from the aiming device, thereby eliminating the operator's need to be in a direct line of sight with the target, and reducing the operator's exposure to hostile conditions that may be present at the location of the device.

Despite the advantages noted, several critical limitations prevent remotely-controlled aiming mechanisms from achieving the desired improvements in accuracy and safety, and consequently such mechanisms have not gained widespread acceptance. First, there is a trade-off between speed and precision of operation in the positioning means. A mechanism capable of fine adjustments to aiming position is usually not capable of making quick gross movements. Mechanisms that can make quick gross movements are usually not capable of fine control. Even when a single device is capable of both rapid gross movements and precise fine control, the gross movements generally achieve only an approximate aiming position, after which fine positioning control must be accomplished, greatly reducing the speed of re-aiming the device following a gross movement or correction.

Second, limitations in eye-hand coordination, muscle control, and perception, generally prevent operators from achieving the precision, speed, or accuracy of aiming movements with a hand remote controller that they could achieve by direct manipulation of a device. Whereas operators can generally manipulate devices quickly to a new point of aim by handling the device, after a minimum of practical training, most operators are unable to operate hand control devices such as joysticks or trackballs with enough control of speed or direction to achieve comparable results.

Third, delays inherent to remote control systems cause operators to overcompensate when making a change in aiming location, thus overshooting their intended target direction. One such delay is mechanical, caused by inertial and other delays in the means of mechanically positioning devices. Another delay is the perceptual lag between the time that an aiming location is achieved and reported (via direct observation or a video signal, for example), and the time the operator becomes aware of and responds to the observed location.

Thus, it would be desirable to create a remote control aiming system for use with small portable devices that achieves accuracy, speed, and precision comparable to, or better than, that achieved by hand operation and aiming of the devices. Specifically, what is needed is an aiming system that incorporates a better system than the prior art for hand operation of remote control units, perceptual feedback of aiming location, and improvements in the means used to position the device.

SUMMARY OF THE INVENTION

In one aspect, the present invention provides a powered aiming mechanism that points a device at a target, where the device is attached to a carriage mounted on a base, and where actuators rotate the carriage on two axes in response to remote-control signals. In the described embodiment, the actuators comprise electronic servomotors that operate threaded shafts to which actuator rods are partly threadedly engaged, and which extend and retract in response to the rotation of the threaded shafts.

In other preferred embodiments each of the servomotors is an electronic stepper motor that operates the threaded shafts forward and reverse by predetermined angular increments. In the described embodiment, the electronic stepper motors may operate either by single steps or at a rate of steps ranging from zero to at least 500 steps per second.

In alternate embodiments, the device pointed by the aiming mechanism may include a sensing instrument, an illumination device, or a semiautomatic firearm. In the case where the device is a semiautomatic firearm, one embodiment is for the device to include a trigger actuator which operates the trigger of the firearm in response to a remote control signal. In one aspect, the carriage includes longitudinal slots with recoil struts so as to absorb recoil forces, and optionally further includes shock absorbing means, and further optionally includes roller cams to steady the recoil struts within the longitudinal slots.

In another aspect, the invention is a remote aiming system that includes a base for engaging a mounting surface, a device connected to the base, positioning means for aiming the device along a horizontal and vertical axis means to control the aiming of the device and to transmit the control signals, means to acquire, transmit, and display video signals of the intended aiming target. In one embodiment the video means comprise video cameras mounted to the device. In another, there are two video cameras: a low-magnification overview camera and a high-magnification aiming camera.

In another aspect, the aiming control means comprise a two-axis hand controller device, as well as signal processing means for converting the output of the hand controller device to electronic control signals used to control the actuators. In alternate embodiments, the hand controller is a joystick, a trackball, or a pressure sensor. In various aspects of the invention, the signal processor operates such that there is a center position or a dead zone in the center of each axis of operation of the hand controller device, where displacement to either side of the center position or dead zone along one axis of control causes the system to alter the position the device along one axis of operation. Optionally, there is an additional "single step zone" outside of the dead zone, where the transition into that zone causes the system to move the device by a fixed amount along one axis of operation. In one embodiment, increasing the displacement causes a corresponding increase in the speed of positioning.

In yet another aspect, the signal processor further produces audio signals in response to the operation of the aiming control means. In one embodiment, there is one audio signal for each axis of operation of the positioning means. In other embodiments, the audio signal consists of the electronic control signals used to control the actuators. In yet other embodiments, the audio signals include tones of pitches that vary in response to the aiming speed of the positioning means along each of its axes of operation.

BRIEF DESCRIPTION OF THE DRAWINGS

The purpose and advantages of the present invention will be apparent to those skilled in the art from the following detailed description in conjunction with the appended drawings, which show a preferred embodiment of the invention, and in which.

DETAILED DESCRIPTION OF THE PREFERRED EMBODIMENTS

Figure 1:
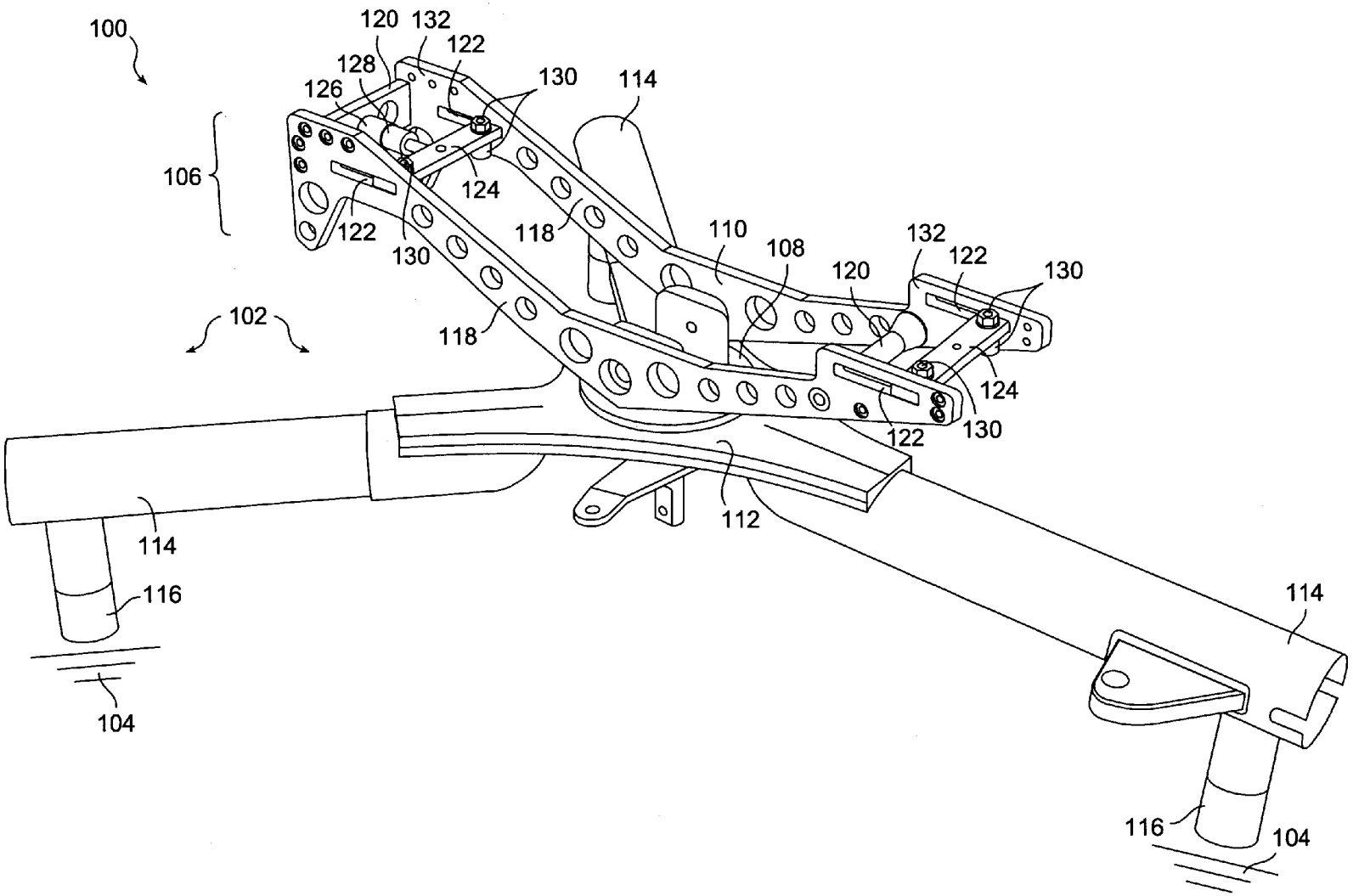
FIG. 1 is an illustration showing an aiming mechanism constructed in accordance with the present invention consisting of a base, to which a carriage is mounted via a first rotational mount and a second rotational mount.

Reference will now be made in detail to the described embodiment of the invention, so as to enable a person skilled in the art to make and use the invention in the context of a particular application and its applications, namely that of aiming a firearm. It is understood that this example is not intended to limit the invention to one preferred embodiment or application. On the contrary, it is intended to cover alternatives, modifications, and equivalents. Various modifications to the present invention will be readily apparent to one of ordinary skill in the art, and can be made to the described embodiment within the spirit and scope of the invention as defined by the appended claims.

For a better understanding, components of the described embodiment are labeled with three-digit component numbers, the first digit of which corresponds to the first figure in which such component appears and is labeled. Like components are designated by like reference numerals throughout the various figures.

In FIG. 1 aiming mechanism 100 is generally illustrated as consisting of base 102, resting on and engaging a mounting surface 104. Carriage 106 is mounted to base 102 via a first rotational mount 108 and a second rotational mount 110.

In the described embodiment base 102 consists of three legs 114 extending horizontally outward from center portion 112. Each leg 114 has a removable foot 116 mounted descendingly therefrom, so as to contact mounting surface 104. A variety of feet 116 are provided for mounting to legs 114, with such feet varying in shape and composition so that the operator may choose the optimal foot to engage mounting surfaces such as rock, soil, metal, wood; available in different lengths to overcome slight deviations from horizontal in the slope of the mounting surface; and provided with alternate fasteners and tips such as bolts or spikes for attaching rigidly to the mounting surface or to a vehicle platform. In a preferred embodiment, legs 114 and feet 116 are hollow tubes made of aluminum, steel, or carbon fiber, with carbon fiber preferred for its light weight and ability to absorb vibration caused by the operation of the aiming mechanism itself and any device mounted thereto.

In the described embodiment, carriage 106 is designed to be attached to a firearm and consists of two approximately identical longitudinal arms 118, parallel to and connected rigidly to each other by a series of cross-members 120, so as to form a unit. At least two slots 122 are cut longitudinally and transversely through the corresponding location on each of the longitudinal arms 118. In each slot 122, a recoil strut 124 is inserted, stretching from one longitudinal arm to the other, so that the edge of the slot 122 permits the recoil strut 124 to move longitudinally but not latitudinally within the slot 122. In order to prevent transverse movement of the recoil struts 124 within the slots 122, two roller cams 130 are mounted to each recoil strut 124 in such a way that they are pressed tightly against and rotate longitudinally along the inner planar surface 132 of each longitudinal arm 118.

Figure 2:
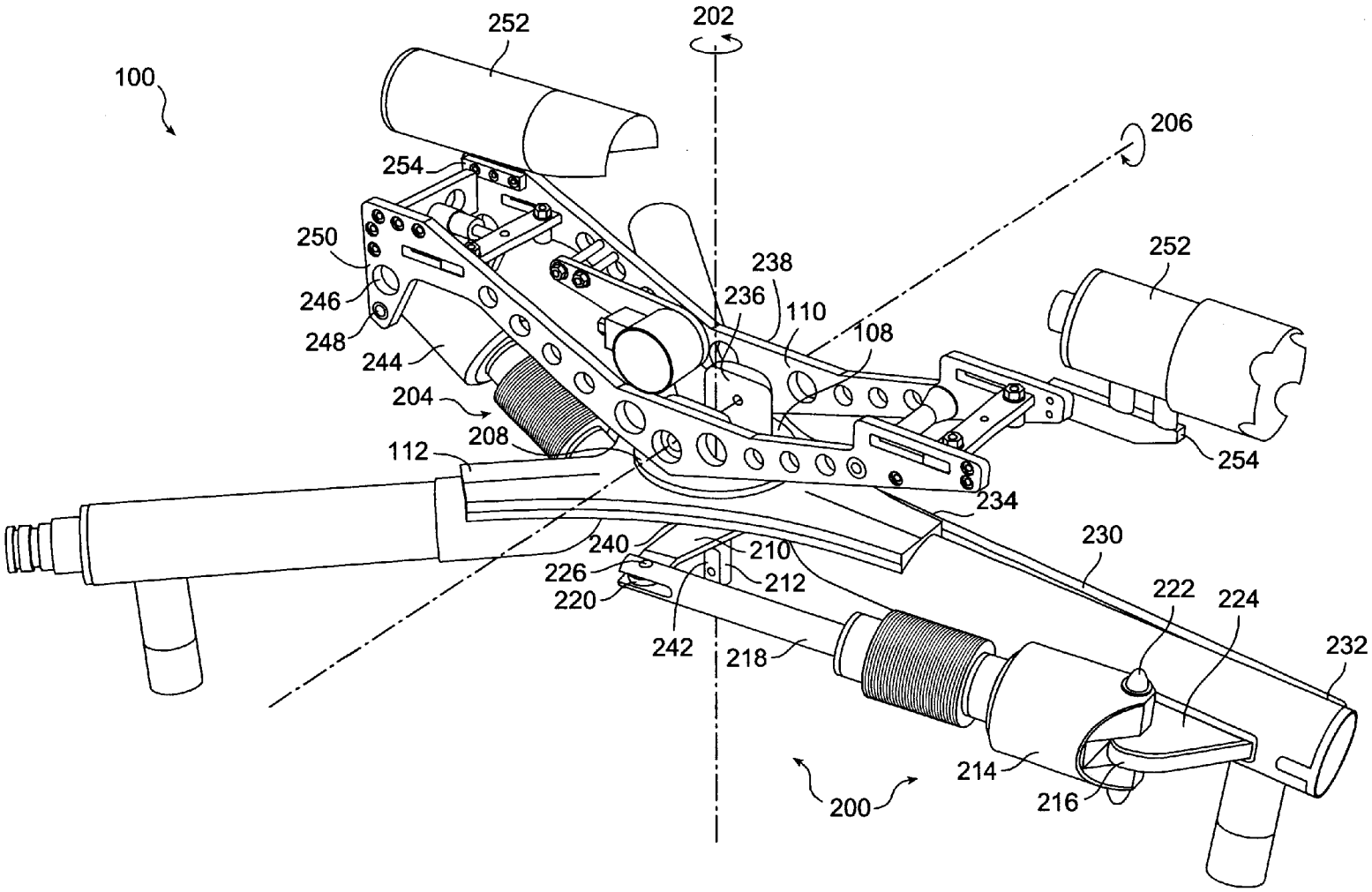
FIG. 2 is an illustration showing an aiming mechanism as in FIG. 1, but further showing camera mounts and hinge pins, as well as linear actuators that serve to rotate the first rotational mount and second rotational mount, thereby positioning the carriage on a vertical axis and horizontal axis respectively.

Turning to FIG. 2 positioning means are illustrated by which carriage 106 may be aimed. Positioning means are provide by a first actuator 200 which controls the rotation of the first rotational mount 108 on a first axis 202, and a second actuator 204 which controls the rotation of the second rotational mount 110 on a second axis 206. Although various configurations are possible, in a preferred embodiment the first axis 202 is approximately vertical and the second axis 206 is approximately horizontal, so that the two axes are substantially perpendicular.

Figure 3:
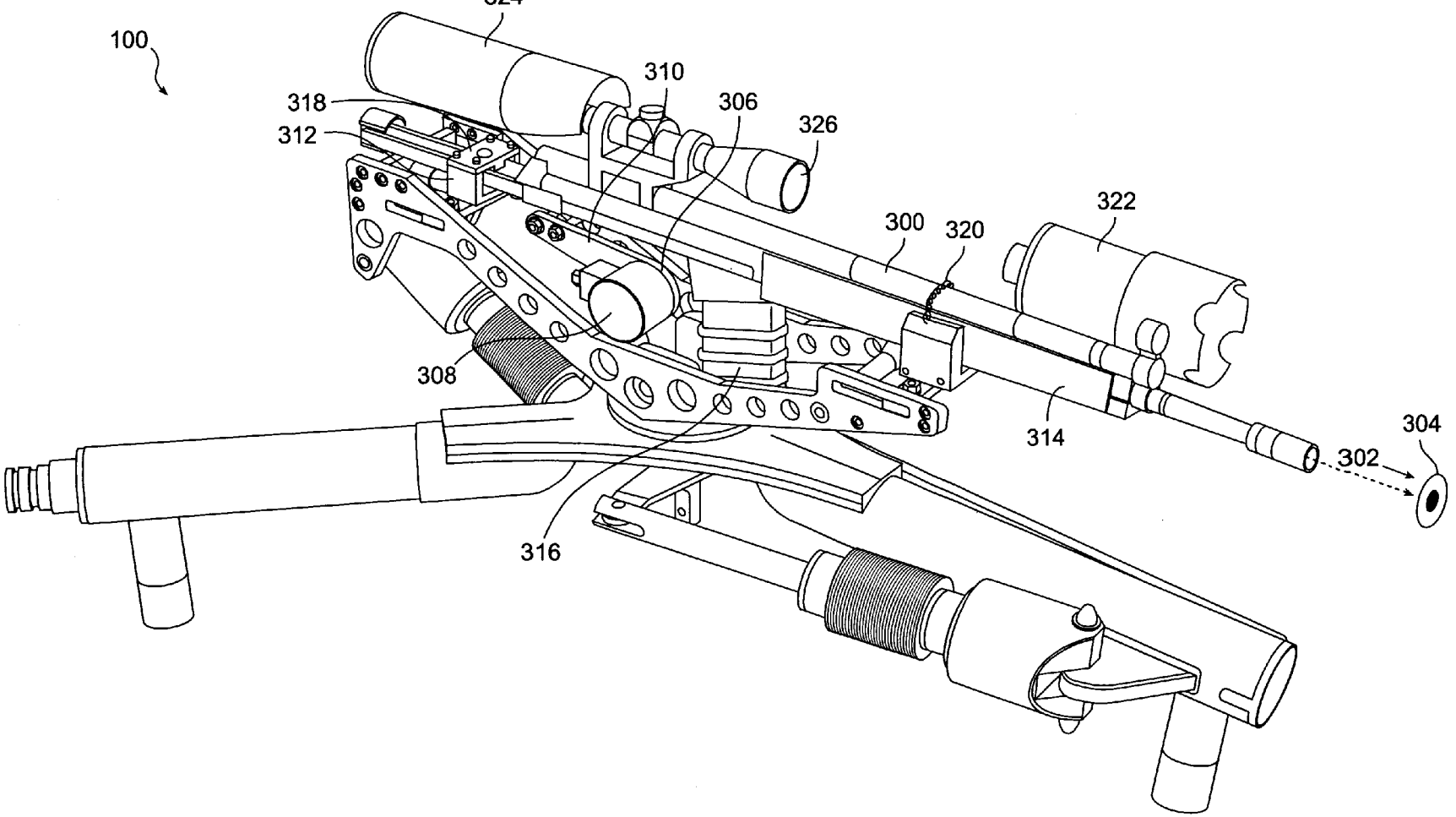
FIG. 3 is an illustration showing an aiming mechanism as in FIG. 2, but further showing a firearm device mounted to the carriage, pointing in an aiming direction towards an intended target.

FIG. 3 shows pointing device 300 attached to carriage 106. When carriage 106 is positioned by the operation of actuators 200 and 204, pointing device 300 is thereby aimed in a pointing direction 302, so as to point at an intended target 304.

In the present application, pointing device 300 is a portable semiautomatic firearm, such as the .308 caliber HK91 rifle. A trigger actuator 308 is mounted to the carriage 106, preferably a rotational actuator, which responds to an electrical control signal by rotating a cam 310 against the trigger 306 in such a way that it alternately engages and releases the trigger, thus firing the firearm device 300.

The firearm device 300 is attached to carriage 106 via gun platforms 312 and 314 attached to each recoil strut 124. The gun platforms 312 and 314 are, optionally, interchangeable and made specifically to fit the shape of the specific firearm device 300 of the described embodiment. On the rearmost gun platform 312, a quick release pin 318 or other fastener is used to secure the firearm device 300 to the gun platform 312 while being readily removable for purposes of replacing the ammunition magazine 316, servicing of the firearm device 300, or for other purposes. A tie-down fastener 320 made of Velcro™ similar material is used to further secure the firearm device 300 to the front gun platform 314.

To reduce shock caused by the firing of the firearm device 300, a shock absorber 126 and recoil spring 128 are mounted between one or more of the recoil struts 124 and the rest of the carriage 106. In the described embodiment, a hydraulic shock absorber 126 extends from the recoil strut 124 to one of the cross-members 120 connecting the longitudinal arms 118. When the firearm device 300 is fired, the recoil force causes the recoil struts 124 to slide backwards within the slots 122, thereby compressing the hydraulic shock absorber 126 and recoil spring 128. The recoil spring 128 then exerts a restorative force that returns the recoil struts 124 to their original position within the slots 122.

Pointing device 300 may also be a sensing instrument such as a video or still camera or sensor, a motion picture camera or sensor, an infrared camera or sensor, a motion sensor, a directional microphone, a spectrometer, a range finder, or a radar receiver. Pointing device 300 may also be an illumination devices such as a spotlight, stage light, laser, radar gun, or searchlight.

In the described embodiment, video acquisition means, consisting of an overview video camera 322 and an aiming video camera 324, are provided for obtaining a live video image of intended target 304. Each of video cameras 322 and 324 is attached to carriage 106 above pointing device 300 via longitudinal hinge pins 254 to permit them to swivel out of the way of pointing device 300 when the device is removed. Each points in the pointing direction 302 of pointing device 300, and each is housed within a protective camera shield 252. In the described embodiment, each camera has a 10-to-1 zoom ratio, resulting in a field of view that ranges from 4.3 to 43 degrees. Overview video camera 322 is mounted to front gun platform 314. Aiming video camera 324 is mounted to the rearmost gun platform 312, and points through a spotting telescope 326 mounted to the pointing device 300. In the described embodiment spotting telescope 326 varies from 3 to 9-times magnification, and includes a reticle so as to indicate the exact pointing direction 302 of pointing device 300.

Returning momentarily to FIG. 2, in the described embodiment first rotational mount 108 is a horizontal turntable which has a first portion 208 rigidly connected to the center portion 112 of base 102. Coupled to the first portion 208 and riding on bearings is a second portion 210 free to rotate on a first axis 202. A descending shaft 212 forms part of the second portion 210, and extends below center portion 112.

In the described embodiment the second rotational mount 110 is a horizontally-aligned axle which has a third portion 236 rigidly connected to the second portion 210 of the first rotational mount 108. Coupled to the third portion 236 and rotating rotate a second axis 206 on bearings is a fourth portion 238. The carriage 106 is mounted to the fourth portion 238.

The first actuator 200 is connected at its first end 214 to the first portion 208 at a point of connection 216, and at its second end 218 to the second portion 210 at a point of connection 220. The first actuator operates in response to an electrical control signal by varying the distance between the second end 218 and the first end 214. As the variable distance increases, rotational force is applied to the second portion 210 at point of connection 220, thus rotating the first rotational mount 108 in an angular direction designated as forward. As the distance decreases, an opposite rotational force is applied to the second portion 210 at point of connection 220, thus rotating the first rotational mount 108 in an opposite angular direction designated as reverse. By controlling the precise distance between the second end 218 and the first end 214, the first actuator 200 thereby controls the rotation of the carriage 106, and thus the precise azimuth of the pointing direction 302. By controlling the rate of change of the distance between second end 218 and first end 214 the first actuator thereby controls a first aiming speed, referring to angular speed of changes in the azimuth of the pointing direction 302.

The second actuator 204 is connected at its first end 240 to the third portion 236 at a point of connection 242, and at its second end 244 to the fourth portion 238 at a point of connection 246. The second end 244 has a variable distance from the first end 240, which distance is determined by the operation of the second actuator 204. The second actuator 204 operates in response to an electrical control signal by varying the distance between the second end 244 and the first end 240. As the variable distance increases, rotational force is applied to the fourth portion 238 at point of connection 246, thus rotating the second rotational mount in an angular direction designated as forward. As the variable distance decreases, an opposite rotational force is applied to the fourth portion 238 at point of connection 246, thus rotating the second rotational mount in an opposite angular direction designated as forward. By controlling the precise distance between the second end 244 and the first end 240, the second actuator controls the elevation of the carriage 106, and thus the precise elevation of the pointing direction 302. By controlling the rate of change of the distance between second end 244 and first end 240 the second actuator thereby controls a second aiming speed, referring to angular speed of changes in the elevation of the pointing direction 302.

In other preferred embodiments, various connection locations are possible. In the described embodiment the connection between the first end 240 and the third portion 236 is via a pivoting mount 248 attached to the descending shaft 212, which is in turn attached to the second portion 210, to which the third portion 236 is rigidly connected, and the connection between the second end 244 and the fourth portion 238 is via a pivoting mount 248 attached to a descending portion 250 of the carriage 106.

It may be readily seen by reference to FIG. 2 that various connection locations and methods are possible between the ends of the actuators and the rotational mounts, subject to the limitation that each point of connection 216 and 220 between the first actuator 200 and the first rotational mount 108 is necessarily offset from first axis 202, and that each point of connection 242 and 246 between the second actuator 204 and the second rotational mount 110 is necessarily offset from second axis 206. Furthermore, at least one point of connection, and preferably both, between each actuator and its corresponding rotational mount must provide a pivot.

In the described embodiment, the connection between the first end 214 and the first portion 208 of first actuator 200 is via a pivoting mount 222 attached to a lateral portion 224 of one of the legs 114, and the connection between the second end 218 and the second portion 210 is via a pivoting mount 226 attached to a lateral attachment 228 to the descending shaft 212. An optional elastic cord 230 made of a resilient material such as rubber is stretched from a second lateral portion 232 of one of the legs 114 to a second lateral attachment 234 of the descending shaft 212, thereby holding the first rotational mount 104 in constant tension during operation, thus reducing the lateral play in the first rotational mount 104 and increasing its lateral stability. Also in the described embodiment, the connection between the first end 240 and the third portion 236 is via a pivoting mount 248 attached to the descending shaft 212, which is in turn attached to the second portion 210, to which the third portion 236 is rigidly connected, and the connection between the second end 244 and the fourth portion 238 is via a pivoting mount 248 attached to a descending portion 250 of the carriage 106.

One of ordinary skill in the art will recognize that many different types of actuators 200 and 204 may be used as positioning means for the carriage including ratchets, cams, and hydraulically-controlled activators. In the described embodiment, actuators 200 and 204 are linear actuators, each consisting of an electronic servomotor 400 housed inside a protective motor housing 402, with a threaded shaft 404 extending longitudinally from the electronic servomotor 400. The threaded shaft 404 rotates forward and backwards, or remains stationary, as operated by the electronic servomotor 400. In the described embodiment, each electronic servomotor 400 is an electronic stepper motor of a type readily available and well known to one of ordinary skill in the art. The forward and reverse rotation of such motors occurs in steps, each of a predetermined angular increment. Such stepper motors operate at precisely-controlled variable speeds in response to electrical control signals received at an electronic control input 406, ranging from stationary (zero steps per second) to at least 500 steps per second, and depending on the motor, as high as 3,000 or more steps per second. The motor rotates a motor shaft 408, which is linked to and thereby drives the threaded shaft 404. There is a further means for locking the threaded shaft 404 in place when it is not in operation.

Figure 4:
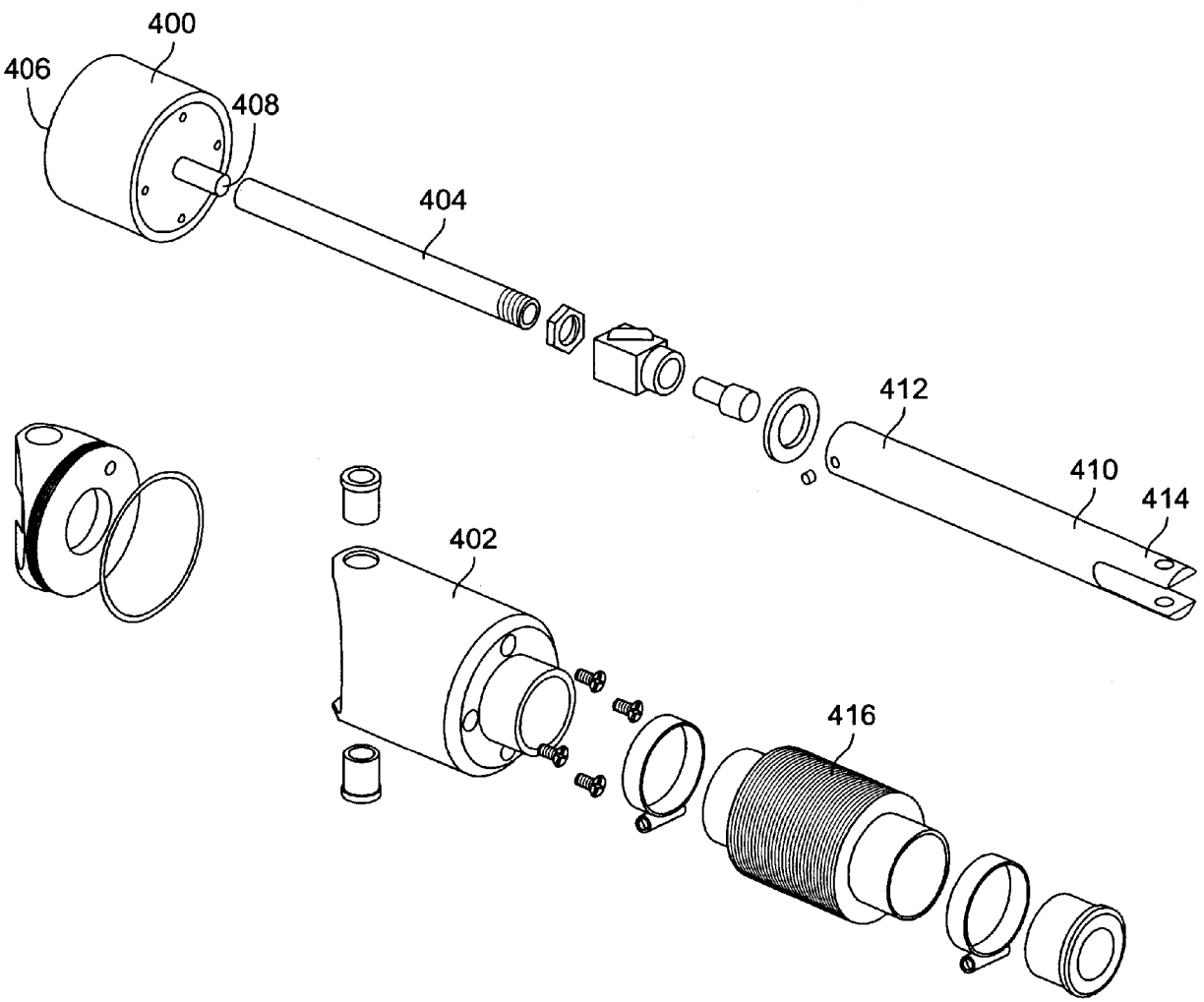
FIG. 4 is an illustration showing the disassembled sub components of each linear actuator, in the relative positions of such components when they are assembled.
Figure 5:
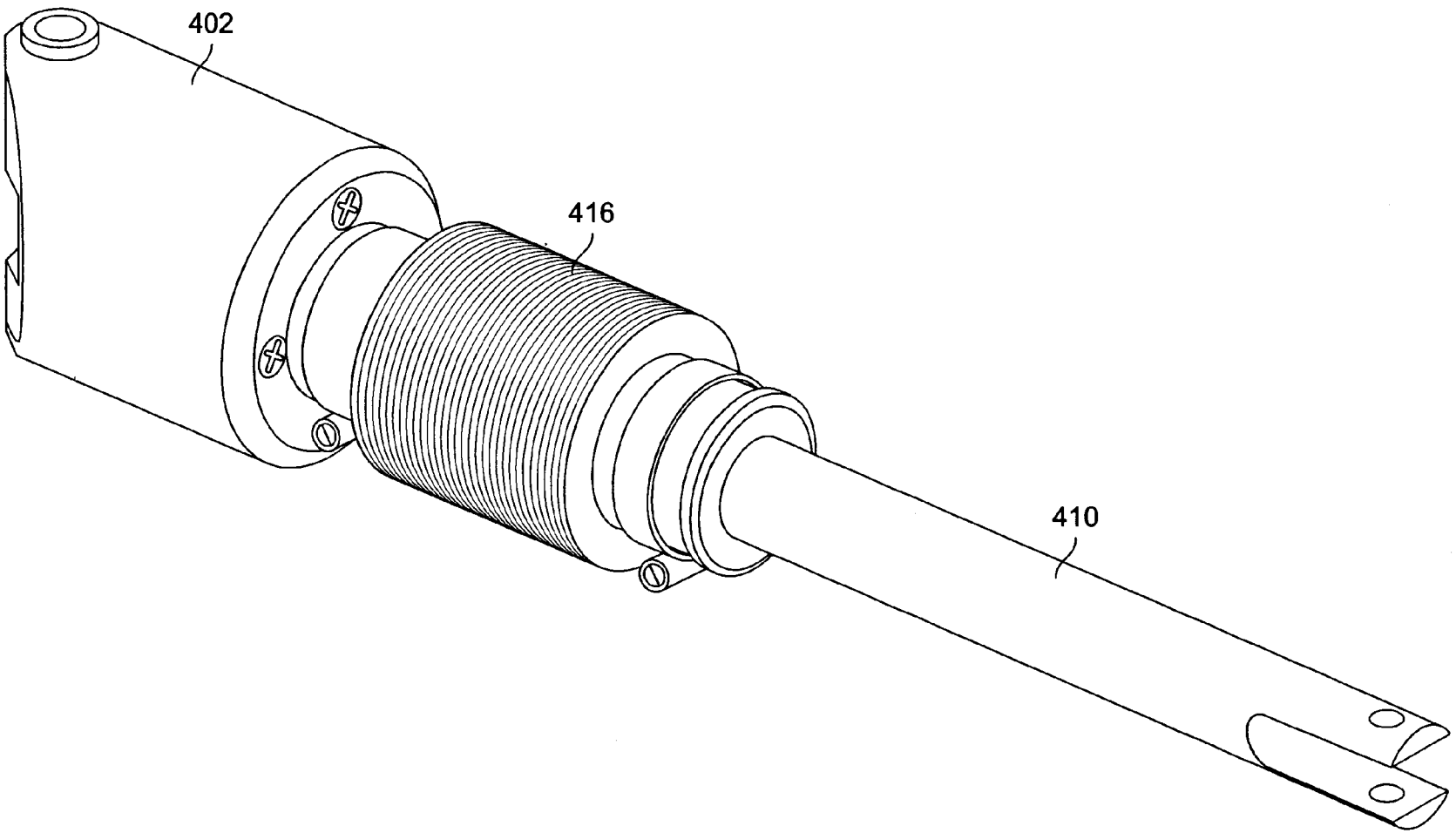
FIG. 5 is an illustration showing an assembled linear actuator.

FIG. 4 and FIG. 5 illustrate in more detail the construction of linear actuators 200 and 204. For each actuator, actuator rod 410 contains reverse threads at one end 412 so as to receive the threads of threaded shaft 404. Actuator rod 410 is partly threaded into and extends longitudinally from the threaded shaft 404, and is connected at the other end 414 in such a way that the rod is not free to rotate. In this way, when electronic servomotor 400 drives the rotation of the threaded shaft 404 in the forward direction, actuator rod 410 is unthreaded from the threaded shaft 404, driving actuator rod 410 away from threaded shaft 404 and, in turn, increasing the distance between end 414 and motor housing 402. Conversely, when electronic servomotor 400 drives the rotation of threaded shaft 404 in the other direction designated as reverse, actuator rod 410 is threaded into threaded shaft 404, driving actuator rod 410 towards threaded shaft 404 and, in turn, decreasing the distance between end 414 and motor housing 402. In the described embodiment the motor housing 402 forms the first end 214 of the first linear actuator 200 and the first end 240 of the second linear actuator 204, and the other end of the actuator rod 410 forms the second end 218 of the first linear actuator 200 and the second end 244 of the second linear actuator 204. A protective cover 416 encloses the connection between the threaded shaft 404 and the actuator rod 410.

It will be understood from the above description that, within a certain range of pointing directions, the azimuth of the pointing direction 302 varies in linear proportion to the number of forward or reverse rotational steps undertaken by the stepper motor 400 of first actuator 200, and thus the precise azimuth and first aiming speed of the pointing direction 302 may be controlled by varying the electronic control signal received by the motor. Further within a certain range of pointing directions, the elevation of the pointing direction 302 varies in linear proportion to the number of forward or reverse rotational steps undertaken by the stepper motor 400 of second actuator 204, and thus the precise elevation and second aiming speed of the pointing direction 302 may be controlled by varying the electronic control signal received by the motor.

Figure 7:
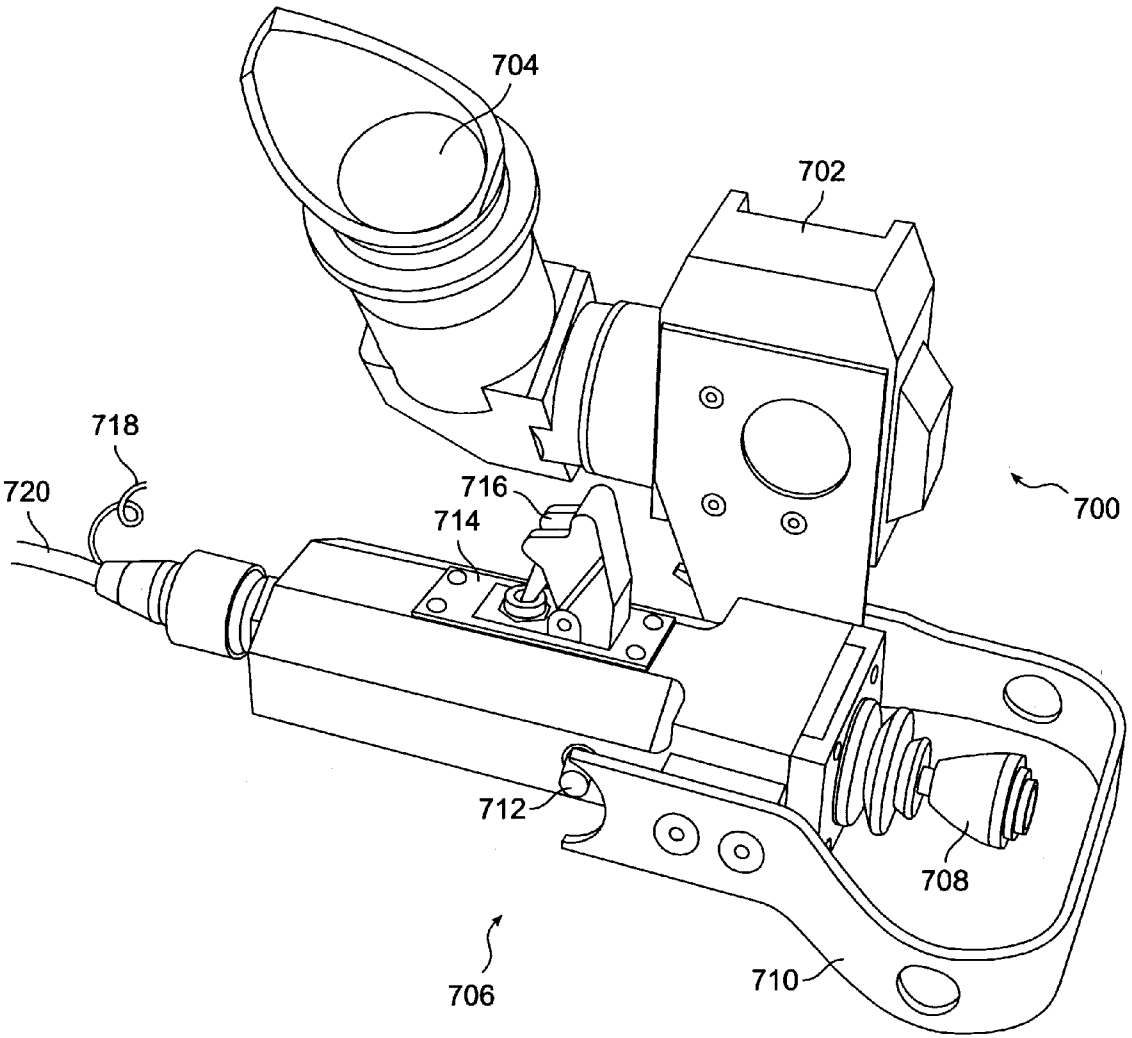
FIG. 7 is an illustration showing a two-axis hand control device that generates input signals for the control unit, and includes a joystick and an optional portable viewfinder.
Figure 8:
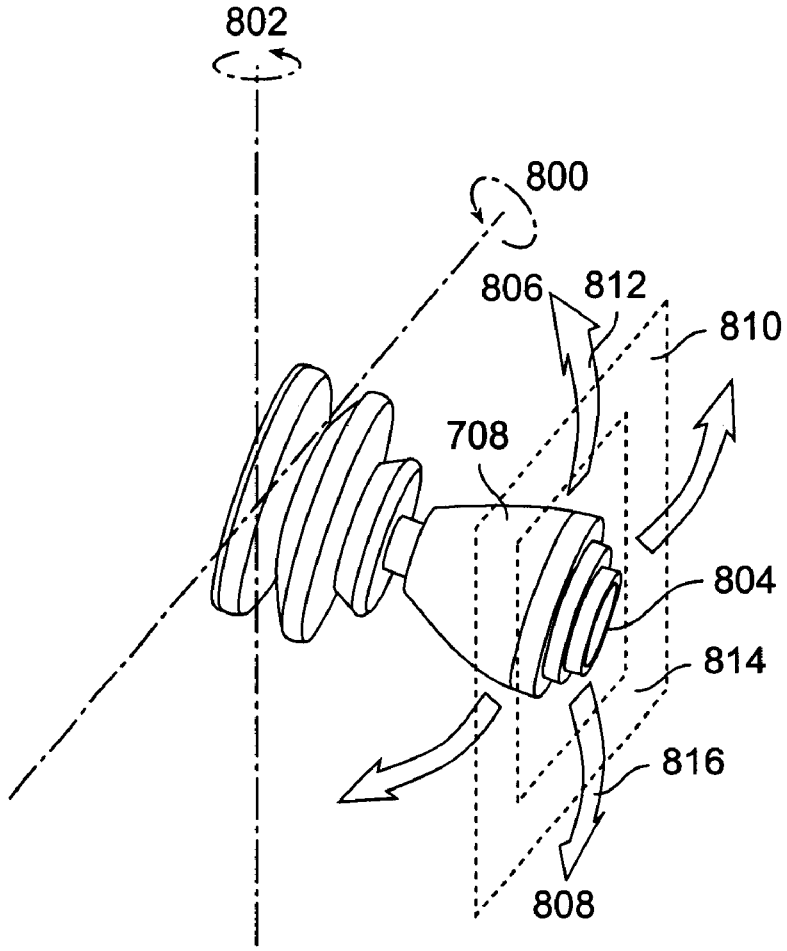
FIG. 8 is a diagram illustrating various positions and zones along which the joystick may be operated in accordance with the present invention.

Briefly, aiming control means for generating the electrical control signals to which the electronic servomotors or other positioning means respond is provided, in the described embodiment, by a two-axis hand controller device 706, shown in FIG. 7 and FIG. 8, which is manually operated by the user of the present invention.

In the described embodiment, two-axis hand controller device 706 is a joystick 708 capable of movement along a first axis 800 and a second axis 802. For each axis there is a mechanical return-to-center feature which automatically returns the joystick 708 to a center position within dead zone 804 approximately in the center of the range of motion of the joystick 708. For each axis there is a positive direction 806 and a negative direction 808 of displacement from the dead zone 804. For each axis, there is a single positive step region 810 the positive direction 806 from the dead zone 804, a region of positive displacement 812 farther in the positive direction 806 from the single positive step region 810, a single negative step region 814 in a negative direction 808 from the dead zone 804, and a region of negative displacement 816 farther in the negative direction 808 from the single negative step region 814.

The two-axis hand controller device also contains a hand stabilizer guard 710 which the operator may hold while manipulating the joystick 708, a first trigger 712 and second trigger 714, a safety switch 716, an audio output 718, and other control switches. In alternate embodiments, the hand controller may incorporate a trackball or a pressure-sensitive device, among other two-axis control devices, in place of or in addition to the joystick 708.

Figure 6:
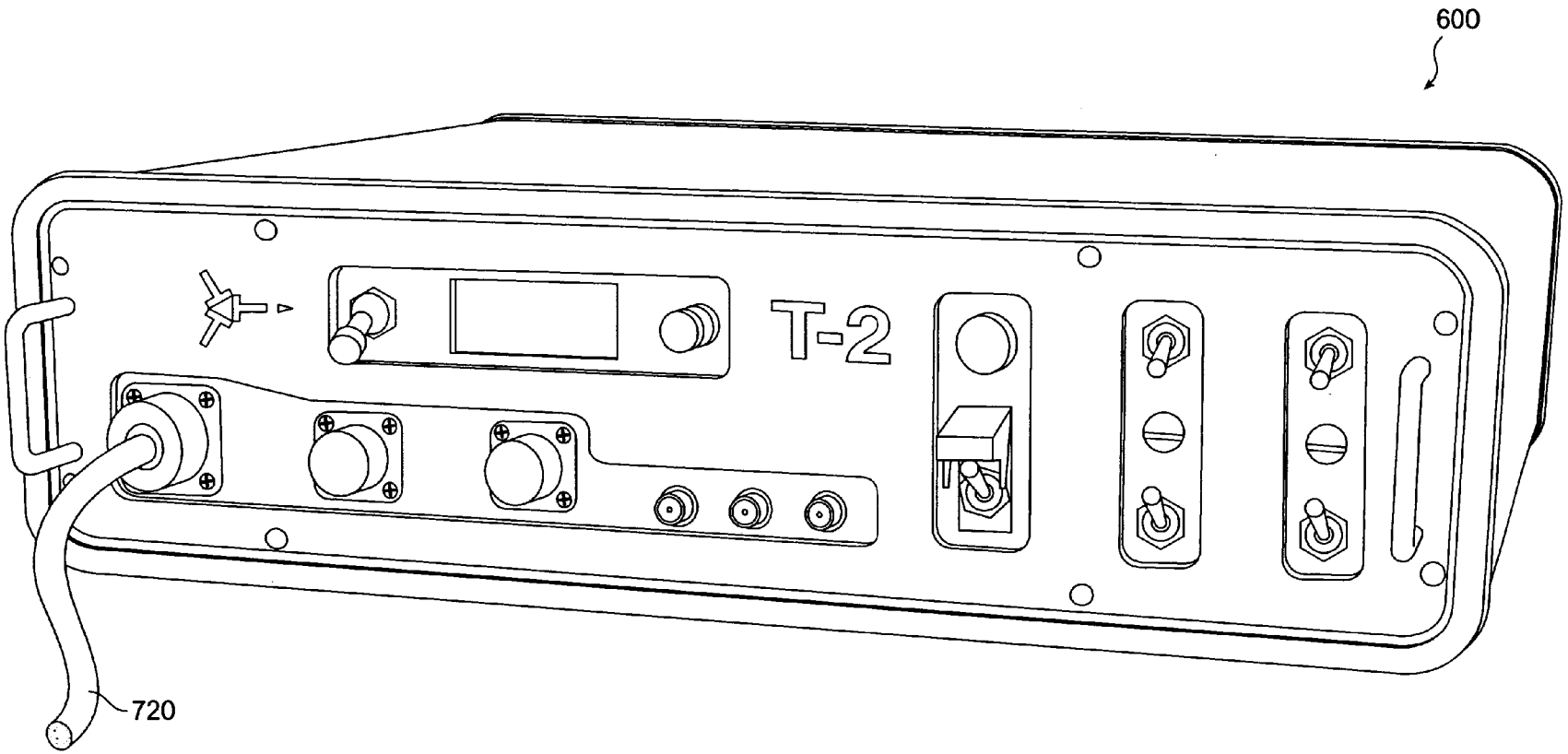
FIG. 6 is an illustration of a control unit that contains signal processing means to generate electrical control signals used to determine the pointing direction of the firearm device.

Operation of hand controller device 706 generates an electrical input signal which is transmitted via an electrical cable 720 or other transmission means to a control unit 600 similar to the one pictured in FIG. 6. The control unit 600 includes means for processing the input signal so as to generate the electrical control signals used to determine the pointing direction 302 of the firearm device 300. Signal processing within control unit 600 may occur via an analog or integrated circuit, or on a microprocessor, preferably on a simple microprocessor chip, in a manner readily understood by one of ordinary skill in the art, by converting voltages or digital signals from the joystick and various triggers and switches to electrical signals that control the electronic servomotors.

In the described embodiment signal processing is performed by microprocessor such that the first axis 800 of hand controller device 706 corresponds to the first axis 202 of aiming mechanism 100, and the second axis 802 of the hand controller device 706 corresponds to the second axis 206 of the aiming mechanism 100. For each axis, the control unit converts a hand controller position that is within the dead zone 804 to an electronic control signal that generates no movement in the pointing direction 302 of the firearm device 300 along the corresponding axis; a transition from the dead zone 804 into the single positive step region 810 or single negative step region 814 into a signal causing movement of the aiming position by a predetermined positive or negative angle respectively, corresponding to a single positive or negative step of the corresponding stepper motor 400, or a position in the region of positive displacement 812 or the region of negative displacement 816 into an electronic control signal that generates a continuous movement in the pointing direction 302 in the positive or negative direction respectively. In the described embodiment, the signal processor converts greater displacements within the region of positive displacement 812 or the region of negative displacement 816 into electronic control signals that cause faster movement of in the pointing direction 302.

Control unit 600 also incorporates control signal transmission means to transmit the electrical control signals to actuators 200 and 204. In the described embodiment, transmission means consist of electrical cable, although in other embodiments a variety of widely known alternate electrical signal transmission means may be used, such as radio frequency transmitters and receivers or fiber optics cable.

In the described embodiment, the control unit also contains audio processing means for generating audio signals in response to operation of hand controller device 706. One audio signal is generated to correspond to each of the axes of operation of the positioning means of the carriage 106. The signal optionally contains a pitch that varies in relation to the speed of operation for the positioning means, preferably including a tone of a frequency proportionately to the speed of aiming of the positioning means when the speed of aiming is above a certain threshold, and a series of audible clicks when the speed of aiming is below or equal to that threshold. When stepper motors are used as positioning means, it is convenient to make the frequency of each signal expressed as cycles per second vary in proportion to the number of positioning steps per second taken by the corresponding motor. In another preferred embodiment, the audio processing means and the means for processing the input signal generated by the hand controller device 706 are the same, so that the audio signal consists of the electronic control signals that determine the pointing direction 302 of the aiming device 300.

It will be apparent to one of ordinary skill in the art that because the frequency of each signal is proportionate to the speed of movement along a corresponding axis, then a movement in any given direction is marked by a ratio of pitches, with the ratio (and hence the perceived interval between the pitches) remaining constant as long as the movement continues in that direction.

Figure 9:
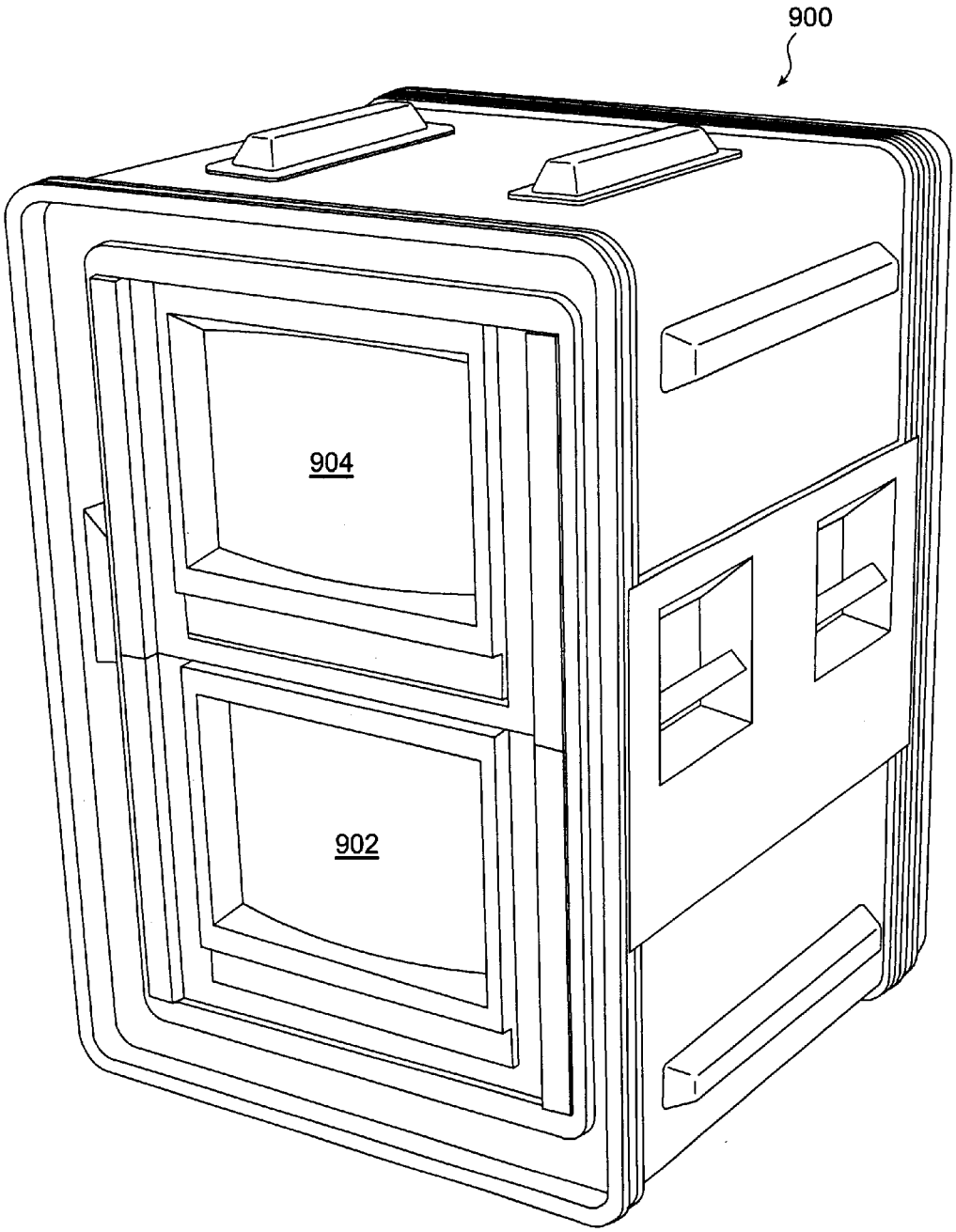
FIG. 9 is an illustration of a command control monitor that displays live video images of the intended target.
Figure 10:
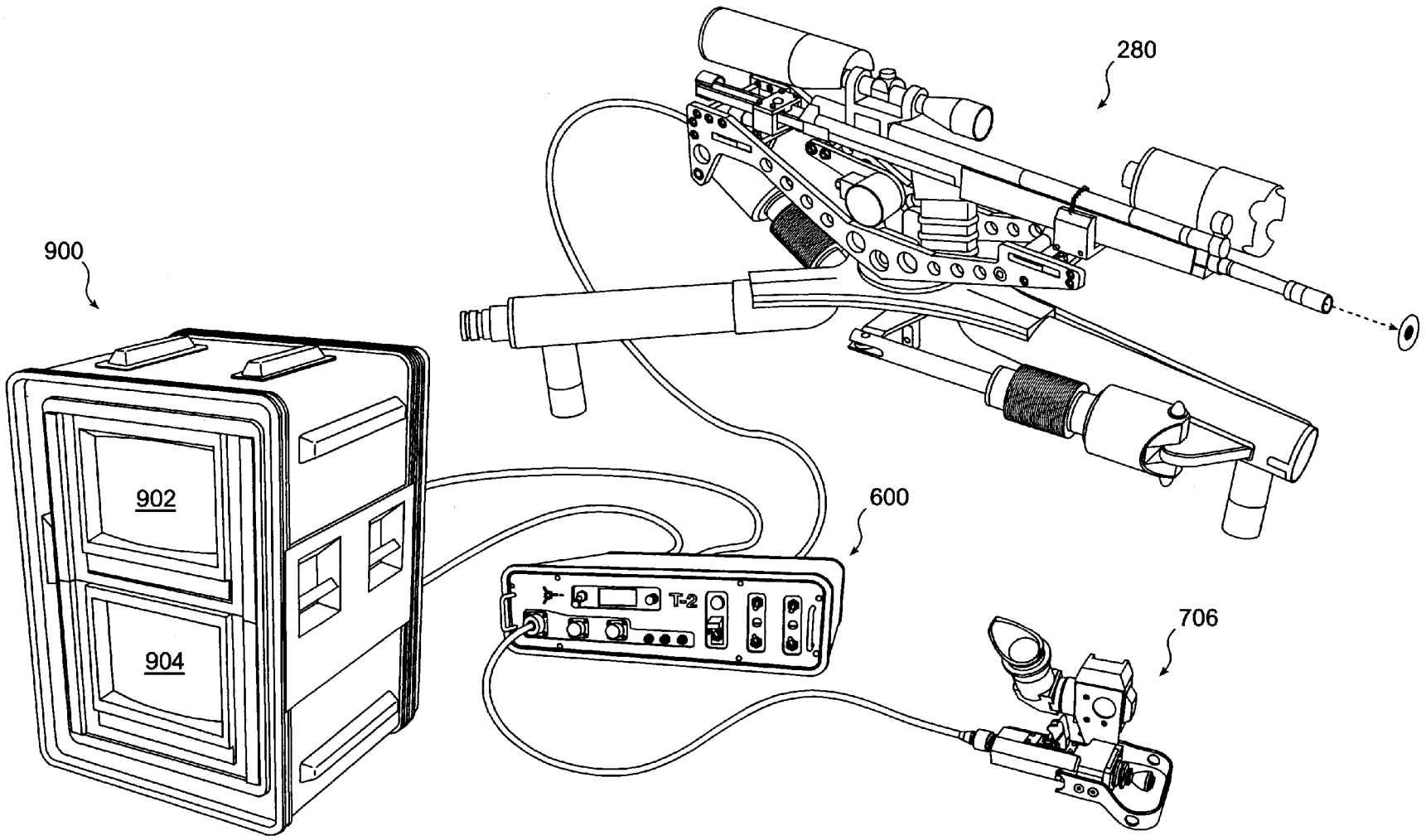
FIG. 10 is an illustration of the remote control system in its entirety.
Figure 11:
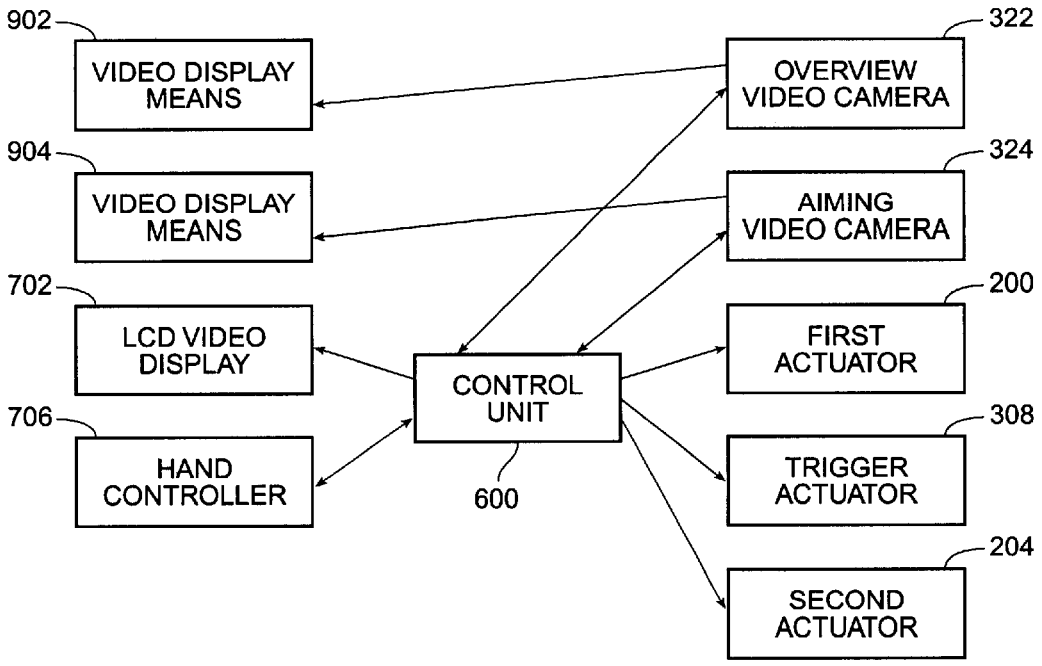
FIG. 11 is flow chart of how the parts interact with eachother.

In the described embodiment, video is displayed on command control monitor 900 similar to that pictured in FIG. 9, with lower video display 902 displaying the live video signal from the overview video camera 322, and upper video display 904 displaying the live video signal from the aiming video camera 324. Video transmission means for transmitting the live video images from the video cameras 322 and 324 to the video display 902 and 904 may consist of a video cable, a radio-frequency transmitter and receiver, an optical fiber, or other conventional means for transmitting video signals that are well known to one of ordinary skill in the art.

Video display means are further provided on an optional portable viewfinder 700, as shown in FIG. 7, containing a small LCD video display 702 viewable through an eyepiece 704. Control means are provided on the portable viewfinder 700 so that the video feed may be switched between overview video camera 322 and aiming video camera 324. Other embodiments may provide for alternate or additional video display means for displaying the live video image from video cameras 322 and 324, including a head-mounted viewer, a small portable video display, and computer-processed representations and models of the video images.

Control unit 600 further contains means for processing input signals from the hand controller device 706, obtaining user input from the control unit 600, and generating electronic control signals, pertaining to operating the trigger actuator 308, the power and zoom features of the video cameras 322 and 324. Optionally, the control unit may distribute power to the other devices, including without limitation the base, the device, and the video acquisition, display, and transmitting means. This power may be obtained from batteries internal to the control unit, or from external sources such as batteries or an alternating current source. Optionally, the control unit may provide that the device may be operated in training mode, where a microprocessor within the control unit processes user input and simulates operation of the device, including operating the audio signal processing, positioning means, and video, but without actually firing the firearm device.

Although the foregoing invention has been described in detail for purposes of clarity of understanding, it will be apparent that certain changes and modifications may be practiced within the scope of the appended claims. For example, the base of the present invention may be a pole rather than a tripod. Alternately, the base may be a large weighted solid, or a mount by which the device is affixed to a vehicle or other platform. In general, it should be noted that there are alternative ways of implementing the apparatus of the present invention. It is therefore intended that the following appended claims be interpreted as including all such alterations, permutations, and equivalents as fall within the spirit and scope of the present invention.

What is claimed is:

1. A remote aiming system comprising, a) a base for engaging a mounting surface;

b) a device connected to said base, and pointing in a direction;

c) a two axis hand controller device manually operated by a user operable by manipulation said hand controller's displacement along a first controller axis and a second controller axis, wherein for each controller axis there is a dead zone region, a single positive step region in a positive direction from said dead zone region, a region of positive displacement from said single positive step region, a single negative step region in a negative direction from said dead zone region, and a region of negative displacement from said single negative step region;

d) signal processing means operationally coupled to said hand controller device, said signal processing means generating said electronic control signals in response to said displacement of said hand controller device along said first controller axis and said second controller axis;

e) positioning means for altering the direction of said device in both a positive and a negative direction, along each of a first aiming axis and a second aiming axis substantially perpendicular to said first aiming axis, in response to electronic control signals, wherein i. when said displacement of said hand controller device along said first controller axis is within said dead zone, said positioning means creates no change in the direction of said device along said first aiming axis;

ii. when said displacement of said hand controller device along said first controller axis enters said single positive step region from said dead zone region, said positioning means creates a positive change of predetermined magnitude in the direction of said device along said first aiming axis;

iii. when said displacement of said hand controller device along said first controller axis is within said region of positive displacement, said positioning means creates a positive movement in the direction of said device along said first aiming axis;

iv. when said displacement of said hand controller device along said first controller axis enters said single negative step region from said dead zone region, said positioning means creates a negative change of predetermined magnitude in the direction of said device along said first aiming axis;

v. when said displacement of aid hand controller device along said first controller axis is within said region of negative displacement, said positioning means creates a negative movement in the direction of said device along said first aiming axis;

vi. when said displacement of said hand controller device along said hand controller device along said second controller axis is within said dead zone, said positioning means creates no change in the direction of said device along said second aiming axis;

vii. when said displacement of said hand controller device along said second controller axis enters said single positive step region from said dead zone region, said positioning means creates a positive change of predetermined magnitude in the direction of said device along said second aiming axis;

viii. when said displacement of said hand controller device along said second controller axis enters is within said region of positive displacement, said positioning means creates a positive movement in the direction of said device along said second aiming axis;

ix. when said displacement of said hand controller device along said second controller axis enters said single negative step region from said dead zone region, said positioning means creates a negative change of predetermined magnitude in the direction of said device along said second aiming axis;

x. when said displacement of said hand controller device along said second controller axis is within said region of negative displacement, said positioning means creates a negative movement in the direction of said device along said aiming axis;

f) control signal transmission means for transmitting said electrical control signals from said signal processing means to said positioning means;

g) video acquisition means for obtaining a live video image of an intended aiming target;

h) video display means for displaying said live video image at a location remote from said device; and i) video transmission means for transmitting said live video image from said video acquisition means to said video display means.

* * * * *